United States Patent [19]

Stahlecker et al.

[11] Patent Number: 4,833,874

[45] Date of Patent: May 30, 1989

[54] YARN PACKAGE EXCHANGE DEVICE AND APPARATUS FOR SPINNING MACHINES FOR DOUBLE PRESTRENGTHENED YARN

[75] Inventors: Fritz Stahlecker, Josef-Neidhart-Strasse 18, 7347 Bad Uberkingen; Dieter Lauschke, Geislingen/Steige, both of Fed. Rep. of Germany

[73] Assignees: Fritz Stahlecker; Hans Stahlecker, both of Fed. Rep. of Germany

[21] Appl. No.: 212,476

[22] Filed: Jun. 28, 1988

[30] Foreign Application Priority Data

May 21, 1988 [DE] Fed. Rep. of Germany ..... 3817405

[51] Int. Cl.[4] ..... D01H 15/00; D01H 1/40; D01H 9/02; D01H 9/10

[52] U.S. Cl. ..... 57/261; 57/22; 57/266; 57/268; 57/276; 242/35.5 R

[58] Field of Search ..... 57/22, 261, 263, 266, 57/268, 269, 270, 276, 278, 279, 299, 315, 61, 62; 242/18 EW, 18 PW, 35.5 R, 35.5 A, 35.6 R, 35.6 E

[56] References Cited

U.S. PATENT DOCUMENTS

| | | | |
|---|---|---|---|
| 3,389,545 | 6/1968 | Grunder et al. | 57/315 X |
| 3,599,416 | 8/1971 | Reuter et al. | 57/315 |
| 3,727,391 | 4/1973 | Hiserman et al. | 57/315 |
| 4,125,990 | 11/1978 | Stahlecker et al. | 242/18 PW |
| 4,154,411 | 5/1979 | Kamp et al. | 242/35.5 A X |
| 4,419,861 | 12/1983 | Fujwara et al. | 57/261 |
| 4,468,919 | 9/1984 | Nakajo et al. | 57/22 |
| 4,470,253 | 9/1984 | Schulz et al. | 57/315 |
| 4,535,945 | 8/1985 | Rohner | 242/35.6 R |
| 4,619,109 | 10/1986 | Suzuki et al. | 57/261 |
| 4,651,515 | 3/1987 | Meroni et al. | 57/261 |

*Primary Examiner*—Donald Watkins
*Attorney, Agent, or Firm*—Barnes & Thornburg

[57] ABSTRACT

In the case of a process and an apparatus for the automatic exchange of yarn packages and spool cores at a spinning unit of a machine having a plurality of spinning units which each spin two prestrengthened yarns and wind them as a double yarn onto a spool core, it is provided that the winding-up is interrupted for the exchange of the yarn packages and spool cores, the full package is replaced by a spool core having a starter winding with a starter yarn, and in that the double yarn coming from the devices for the spinning and the starter yarn are placed in a splicing arrangement and are spliced together with one another, after which the winding-up is restarted.

17 Claims, 3 Drawing Sheets

A
B
C
D
E
1
2
II
II
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
50
51
52
53

YARN PACKAGE EXCHANGE DEVICE AND APPARATUS FOR SPINNING MACHINES FOR DOUBLE PRESTRENGTHENED YARN

BACKGROUND AND SUMMARY OF THE INVENTION

The invention relates to a process and an apparatus for automatically exchanging yarn packages and spool cores at a spinning unit of a machine having a plurality of spinning units which each contain devices for the spinning of two prestrengthened yarns and devices for winding these two yarns, as a double yarn, onto a spool core, these packages serving as feeding packages for a subsequent twisting operation.

It is known (German Published Examined Application - DE-A No. 36 34 464), in the case of an exchange of yarn packages and spool cores, or also when starting to spin on a machine, to insert empty spool cores into the spinning units to which then, at each spinning unit, the spun double yarn is guided by means of a suction gripper. The spool core grips the double yarn by means of adhesive force and starts the winding-up. In the known construction, it is also provided for repairing a yarn breakage that the double yarn wound up on the spool core is gripped, unwound and placed in a splicing device, into which the newly spun double yarn is also placed. In the splicing device, a spliced connection is produced, after which the winding-up process is restarted.

An objective of the invention is to simplify the automatic exchange of yarn packages and spool cores at the spinning units of a spinning machine of the above-mentioned type.

In the case of the process, this objective is achieved in that the winding-up is interrupted, the full yarn package of the spinning unit is taken out of the devices for the winding-up and is replaced by a spool core having a starter winding with a starter yarn, and in that the double yarn coming from the devices for the spinning and the starter yarn are placed in a splicing device and are spliced together with one another, after which the winding-up is restarted.

By means of this development, it is achieved that the operations during the automatic exchange of yarn packages and spool cores correspond as much as possible to the operations during an automatic yarn breakage repair, so that only for the exchange of the yarn packages and spool cores, additional devices must be provided for the removal of the full package and for replacing it with the spool core equipped with the starter winding. The remainder of the operations required for the exchange of yarn packages and spool cores and for the restarting of the spinning unit may be carried out by devices which are also used for a piecing after a yarn breakage of one or both yarns. As a result, important constructive simplifications are achieved since the operations are standardized.

In a spinning machine, this objective is achieved in that devices are provided for separating a full yarn package from the devices for the winding-up as well as devices for replacing the full yarn package with a spool core having a starter yarn, a splicing device, devices for placing the starter yarn and the double yarn coming from the devices for the spinning in the splicing device and devices for rewinding the double yarn connected with the starter yarn and for transferring the spool core to the devices for the winding up of the spinning unit.

In a further development of certain preferred embodiments of the invention, it is provided that a single yarn is provided as the starter yarn with a strength that is increased with respect to the double yarn and/or of a coarser yarn size. A starter yarn of this type has the advantage that, on the one hand, it can have a higher strength and, on the other hand, mainly on the spool core equipped with the starting winding, can be found relatively easily by means of an automatic searching device and can be withdrawn from the spool core. In this case, it must, however, be provided that the twisting process is carried out such that the feeding package is maximally used up during the twisting-together only up to the starter winding.

In another preferred embodiment, it is provided that, as the starter yarn, a double yarn is used which, with respect to the material and the thickness, corresponds to the double yarn produced by the devices for the spinning. This has the advantage that each of the produced yarn packages, during the twisting, can be used up to the end including the starter winding. In order to facilitate the finding for an automatic device also in this development, it is provided in a further development of the invention that the ends of both yarns that form the double yarn serving as the starter yarn are connected with one another. As a result, it is ensured that the two components of the double yarn are withdrawn simultaneously. In a further development, it is provided that the end of the starter yarn is reinforced.

Other objects, advantages and novel features of the present invention will become apparent from the following detailed description of the invention when considered in conjunction with the accompanying drawings.

DETAILED DESCRIPTION OF THE DRAWINGS

Figure 1:
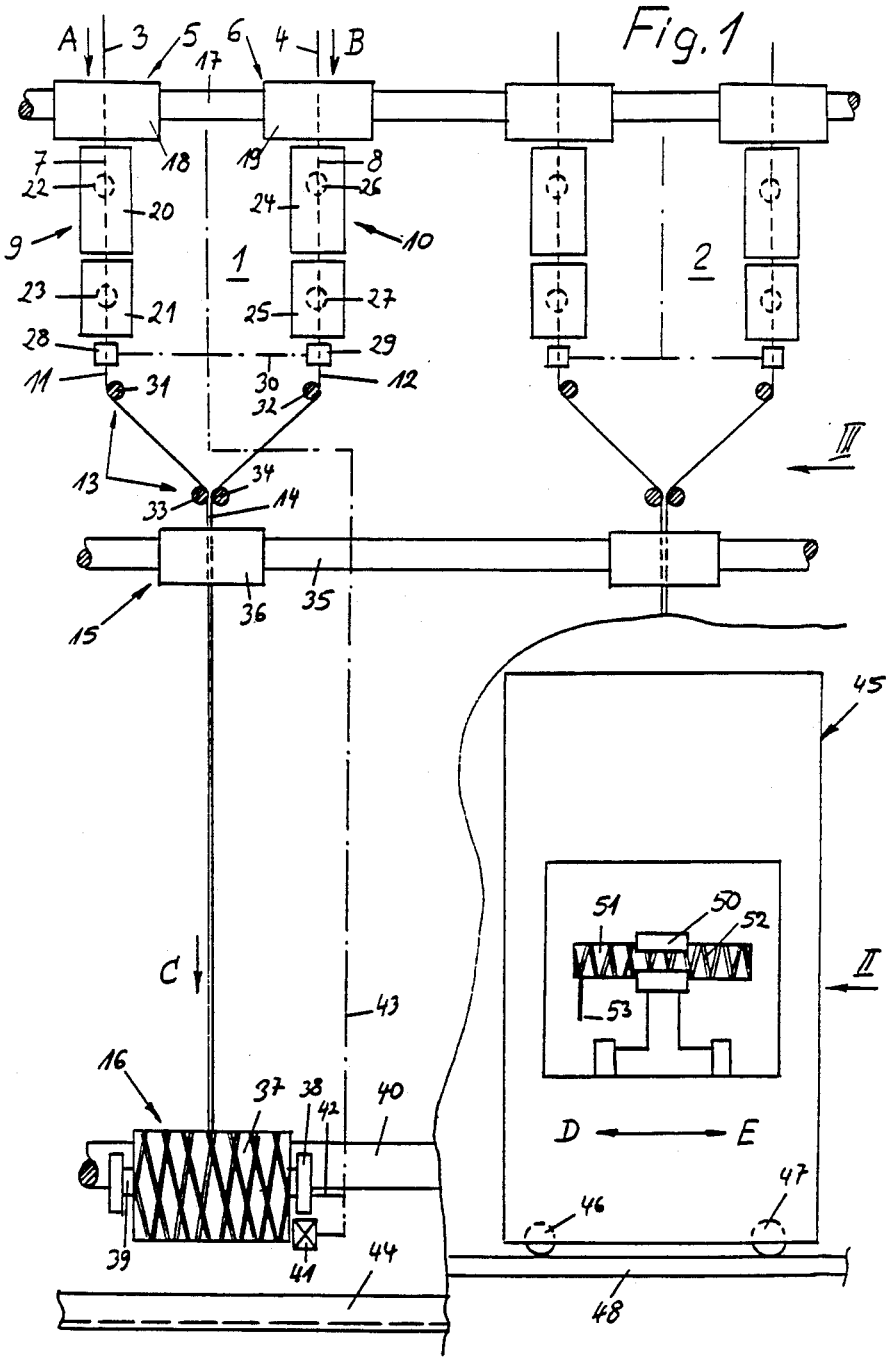
FIG. 1 is a partial schematic view, from the direction of the operating side, of a spinning machine having a movable servicing device, constructed in accordance with a preferred embodiment of the invention.

The spinning machine, which in FIG. 1 is shown with only two spinning units 1, 2, has a plurality of spinning units of this type that are arranged in a row next to one another. At each spinning unit, two slivers 3, 4, travelling in the 5, 6 in which they are drawn to the desired yarn size. The yarn components 7, 8 coming out of the drafting frames enter into pneumatic false-twisting devices 9, 10 in which they are prestrengthened. The prestrengthened yarns 11, 12 are guided together by means of yarn guiding devices 13 to form a double yarn 14 that is withdrawn by a withdrawal device 15. The double yarn then moves in the direction of the Arrow (C) to one wind-up device 16 respectively on which the cross-wound packages 37 are produced onto which the double yarn is wound side by side.

The drafting frames 5, 6, in a conventional manner, contain bottom rollers extending in the longitudinal direction of the machine that are driven at the end of the machine and of which only that bottom roller 17 is shown that is part of the pair of delivery rollers. At each drafting frame, pressure rollers 18, 19 are assigned to these bottom rollers and also to the bottom roller 17, these pressure rollers 18, 19, in a known manner, being developed as pressure roller duos and being held in a weighting arm that is not shown.

The false-twisting devices 9, 10 are constructed as pneumatic false-twisting devices which, in each case, contain two air nozzles 20, 21; 24, 25 which are connected to compressed-air supply lines 22, 23; 26, 27. The respective first air nozzle 20, 24 is developed as a so-called intake nozzle which exercises no or at least almost no twist on the yarn components 7. The air nozzles 21, 25 that follow are the false-twisting nozzles, by means of which a false twist is applied to the yarn components 7, 8 which, however, opens up behind these air nozzles 21, 15. However, several yarn ends remain wound around the essentially untwisted yarn core.

Directly behind the air nozzles 23, 25, yarn guards or detectors 28, 29 are arranged which affect the wind-up device and also the drafting frames 5, 6 in a manner described below and shown by the dash-dotted lines 30, 43.

The yarn guiding devices 13 comprise yarn guiding pins 31, 32, which are arranged directly behind the yarn detectors 28, 29, and of yarn guiding pins 33, 34 which follow, arranged at a narrow distance with respect to one another, and which combine the two prestrengthened yarns 11, 12 to a double yarn 14. These two yarn guiding pins 33, 34 are arranged directly in front of the withdrawal device 15. This withdrawal device 15 contains a bottom roller 35 extending through in the longitudinal direction of the machine and being driven at the machine end. At each spinning unit 1, 2, a pressure roller 36 is assigned to this bottom roller.

The wind-up device 16 comprises a winding roller 40 extending through in the longitudinal direction of the machine and driven at the machine end, on which the package 37 rests in the normal operation, which is then driven by the winding roller 40.

Figure 2A:
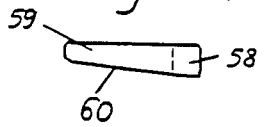
FIG. 2*a* is a view of a detail of the servicing device of FIG. 2.
Figure 2:
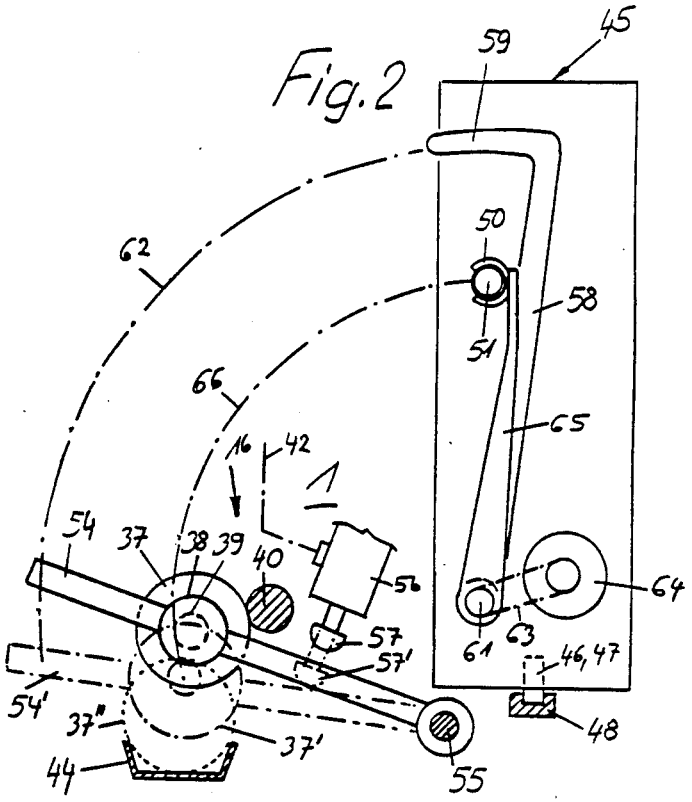
FIG. 2 is a partial lateral schematic view of the spinning machine and the movable servicing device of FIG. 1.

As shown in FIG. 2, the spool is held in a spool frame 38 accommodating the spool core 39 on which the package 37 is built up. Part of the wind-up device 16 are additional devices not shown here, such as the traverse-motion guide and devices for compensating different lengths and tensions in the double yarn 14 caused during the traverse motion.

As shown in FIG. 2, the spool frame 38 can be pivoted around a stationary shaft 55. The spool frame 38 has at least one arm 54 that can be moved away from the spool core 39 in transverse direction so that, as a result, the spool core and therefore also the package 37 are released.

Also assigned to the spool frame 38 is a control element 56 which, by means of a pressure element, acts against the spool frame and swivels it around the shaft 55 in such a manner that the package takes up position 37' in which it is separated from the winding roller 40. Thus the drive of the Package 37' is interrupted.

As shown in FIG. 1, a sensor 41 is assigned to the spool frame 38, this sensor 41 monitoring the degree of fullness of the package and interrupting the spinning process when a given degree of fullness is reached. For this purpose, the sensor 41 is equipped with devices for interrupting the sliver supply 3, 4 in the area of the drafting frames 5, 6. The interruption may take place in that the drafting frames 5, 6 are opened up by a swivelling-away of the weighting arm accommodating the pressure roller duos, or in that sliver stop devices are actuated. In the same manner, the sensor 41 actuates the control element 56 which is indicated via the line 42. The control element 56 as well as the devices for interrupting the sliver supply are also actuated by the yarn detectors 28, 29, in which case, the response of one of the two yarn detectors 28, 29 is sufficient. In the case of a yarn breakage and when the given degree of fullness of the package 37 is reached, the respective spinning unit 1, 2 is therefore changed to the same (inoperative) state. When the given degree of fullness of the package 37 is reached, that sensor 41, however, has responded that also transmits signals to the servicing devices, that will be explained below, with the objective that an exchange of yarn packages and spool cores is carried out and, for the time being, no piecing attempt must yet be made.

When the package 37 has reached the given degree o fullness and the sensor 41 has responded, the package 37 is in position 37' into which the spool holding device 38 was swivelled. The servicing apparatus or unit shown in FIGS. 1 and 2 will then be called to the respective spinning unit 1, 2. This servicing unit 45 removes the full package 37' from the spool holding device 38 and subsequently inserts a spool core 51 into the spool holding device 38. The servicing unit 45 contains a spreader lever 58 which can be applied to the arm 54 of the spool frame 38 that can be swivelled away laterally, this arm 54 being in position 54'. The spreader lever 58 has a projection 59 which, along the orbit 62, can be swivelled around the shaft 61 toward the arm 54'. In this case, it places itself, with a lateral stop surface 60 which ascends in a wedge-shaped manner, against the arm 54' and swivels it away from the package 37 or the spool core 39. The package 37', in this case, falls into position 37'', i.e. onto a conveyor belt 44 by means of which it is moved away. The spreader lever that can be swivelled around the shaft 61 is driven by means of an actuator 64 via a toothed belt 63.

While the spool frame 38, by the lowering of the arm 54' by means of the spreader lever 58, is still held in the spread position, a spool core 51 is placed in the spool frame 38. The spool core 51 is applied by a gripper 50 of a swivelling lever 65 which can be swivelled around the same shaft 61 on a path 66 to the spool frame 38. The swivelling lever 65 with the gripper 50 holds the spool core 51 in the area of the spool frame 38, while the spreader lever 58 is moved back. The arm 54, which is located in position 54', therefore swivels back and inserts the spool core 51. The swivelling lever 65 then moves back into the servicing apparatus 45 and leaves the spool core 51 in the spool frame 38. The servicing apparatus 45, by means of running wheels 46, 47, can be moved in tracks 48, in which case at least one of the running wheels 46 or 47 is driven so that the servicing apparatus 45 can move in the direction of the Arrows (D and E).

As shown in FIG. 1, the spool core 51, which replaces a full package 37, is equipped with a starter winding 52; i.e., a starter yarn 52 was wound several times onto the spool core 51 before the spool core 51 is inserted into the spool frame 38. As shown in FIG. 1, the end 53 of the starter yarn 2 is located at a defined point in the area of an end face of the spool core 51, projecting slightly away from the spool core 51. The winding of the starter yarn 52 around the spool core 51 is so long that a sufficient length of the starter yarn 52 can be withdrawn from the spool core 51 during a piecing Process that will be described below. The servicing device 45 is equipped with a magazine that is not shown in which it carries along the spool cores 51 provided with the starter winding. It also contains a transfer device by means of which the spool cores can be taken out of the magazine and can be transferred to the gripper 50.

After the transfer of the spool core 51 with the starter winding to the spool frame 38, the spinning unit is in a condition that corresponds exactly to the condition which also exists after a yarn breakage, and from which an automatic piecing takes place. This automatic piecing is explained b means of FIG. 3, which shows a supplementary version of the servicing unit 45. It is also contemplated to integrate the devices for removing the full package 37 and for inserting the starter spool 51 into the same servicing unit 45 which carries out a piecing operation. It is also contemplated to house these devices in two separate servicing units which move along the machine independently of one another or behind one another.

Figure 3:
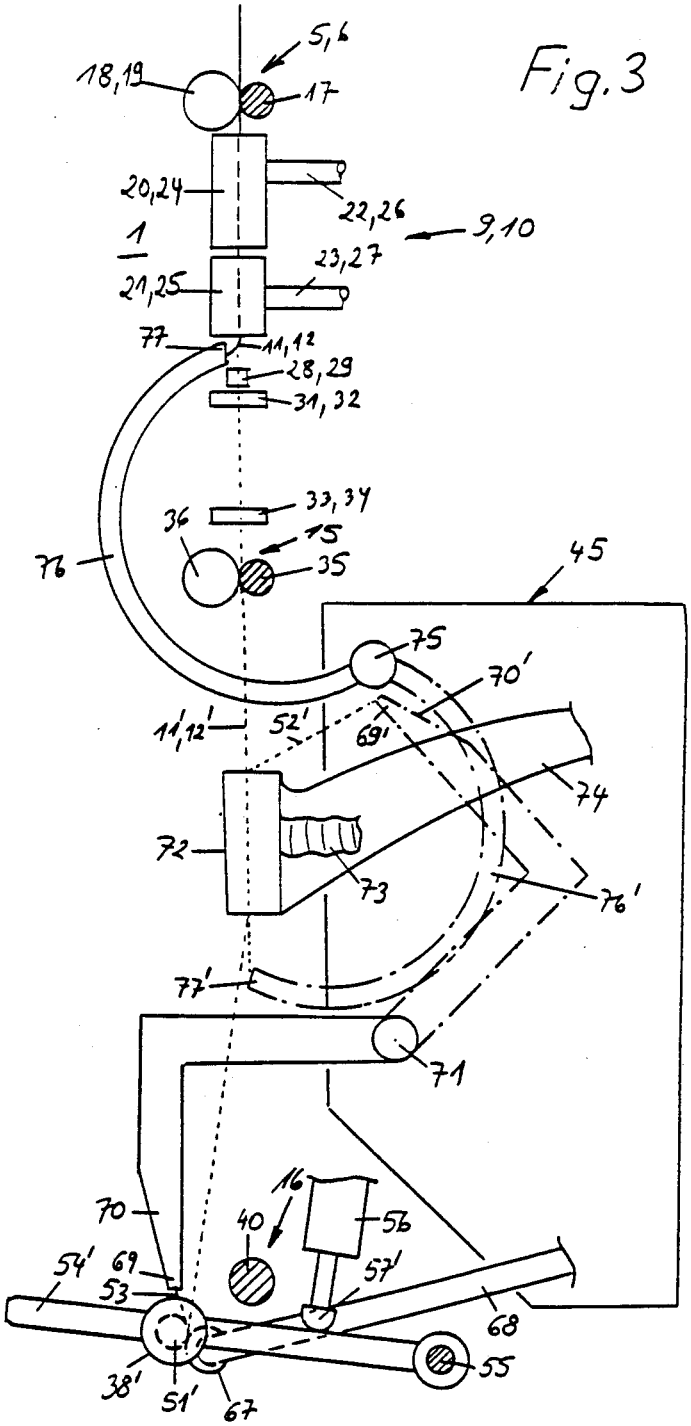
FIG. 3 is a lateral view taken in the direction of the Arrow III of FIG. 1 of the spinning machine and schematically depicting a device for transferring the double yarn coming from the spinning devices and a starter yarn of a spool core to a splicing device.

The servicing unit 45, which is applied to the respective spinning unit 1, 2, is equipped with two pneumatic yarn searching nozzles 70, 76. Yarn searching nozzle 70 can be swivelled around a shaft 71 between the position shown by solid lines and the position 70' shown in dash-dotted-lines. The yarn searching nozzle 70 is applied to the spool core 51' provided with the starter winding, so that it grips the end 53 of the starter yarn and sucks it into its suction opening 69. The servicing unit 45 is equipped with an auxiliary winding roller 67 which is arranged on an arm 68 that can be selectively moved out of the servicing unit 45 and can be applied to the spool core 51'. The auxiliary winding roller 67 can be driven in unwinding as well as in winding direction. The spool core 51' is first driven in unwinding direction, in which case the searching nozzle 70 swivels back to its position 70' and in the process withdraws the starter yarn 52' from the spool core 51' and takes it along. The servicing unit 45 is equipped with a splicing device 72 which is connected to a pressure supply line 73 and is arranged on an arm 74 of the servicing device 45. As shown in FIG. 3, the starter yarn 52' withdrawn from the spool core 51' is inserted in the splicing device 72.

The second yarn searching nozzle 76 can be swivelled around a shaft 75 of the servicing unit 45 between the position shown by solid lines and the dash-dotted position 76'. The yarn searching nozzle 76, by means of its suction openings 77, grips the two prestrengthened yarns 11, 12 at the outlet of the false-twisting devices 9, 10 of the respective spinning unit, after the supply of the liver and thus the operation of the drafting frames 5, 6 has resumed. The yarn searching nozzle 76 then takes along the prestrengthened yarns 11, 12 that are combined to form a double yarn and places them in the splicing device 72. These yarns will then take up position 11', 12', being placed, by means of guiding elements that are not shown, around the yarn guiding pins 31, 32, 33, 34 and being introduced into the withdrawal device 15. After the splicing of the starter yarn 52' with the double yarn formed by yarns 11', 12', the auxiliary driving roller 67 is driven in winding direction so that first the starter yarn 52' and then the newly spun double yarn are wound onto the spool core 51'. After the excessive yarn length occurring during a piecing has been used up, the speed of the auxiliary winding roller 67 is reduced to the operating speed of the winding roller 40, after which the spool core 51' is transferred to the winding roller 40 by the swivelling-back of the spool frame 38.

As mentioned before, the devices for carrying-out the Piecing operation are shown only in a very diagrammatic form. Yarn searching nozzles that correspond to yarn searching nozzles 70, 76 are known, for example, in automatic winding machines that must also be developed and guided such that they move past a splicing arrangement while inserting the yarns. A special feature of the piecing in a spinning unit corresponding to the present invention, compared to winding machines, is the fact that during the splicing, one of the two yarns to be wound, specifically the double yarn formed from the yarn components 11, 12, moves at full production speed. Since in the area of the splicing device 72, the double yarn must be stopped for a short time, a yarn storage device is arranged between the splicing device 72 and the withdrawal device 15, this yarn storage device being able to accommodate the yarn length that occurs in the operation. This yarn storage device then, after the splicing operation, is emptied by the driving of the spool core 51' by means of the auxiliary winding roller 67 at an increased speed, before the spool core 51' is transferred to the winding roller 40.

For reasons of simplicity, it was assumed in the above-mentioned statements that the search for the end of a double yarn after a yarn breakage as well as for the end 53 of the starter yarn is to take place at the circumference of the spool core 51 or of a package 37. However, it is also contemplated, as a modification of this process, to stop the spinning units, in the case of a yarn breakage, in such a manner that the unbroken yarn component, in a holding device, such as a yarn clamp or a suction nozzle, is still located in front of the winding device and is kept available there. Also in this case, the inserting of a spool core 51 having a starter winding 52 according to the invention may be provided, but the inserting must take place such that the end 53 is then transferred to the respective yarn holding device of the spinning unit. Since this transfer is carried out by the movable servicing unit 45, it is not too crucial that it results in relatively high expenditures since it is required only once for each machine. Also in the case of this type of a development, the servicing device that is provided for repairing a yarn breakage can complete the exchange of spool cores and packages and the resumption of the spinning operation so that, in addition, only devices must be provided by means of which a full package is taken out of the respective spinning unit 1, 2 and is replaced by a spool core 51 that is provided with the starter winding 52.

The starter winding 52 of the spool core 51, in a first embodiment of the invention, may consist of a single yarn, a so-called auxiliary yarn. This auxiliary yarn, which has a higher strength than the double yarn and may also have a coarser yarn size, can be found relatively easily on the spool core by an automatic searching device, particularly the yarn searching nozzle 70, and can be withdrawn. However, in the case of this development, it is necessary that during the twisting of the subsequently wound-up double yarn, care is taken that the starter yarn is cut off beforehand.

In another embodiment, it is provided that the starter yarn is developed as a double yarn which corresponds to the conventionally spun double yarn. This has the advantage that the whole package can then be twisted. In order to facilitate the finding and withdrawing of this type of a double yarn, it is provided that the two ends of the components of this double yarn are located at the same point, which, in a very simple manner, is achieved by cutting them off at the same point when the starter yarn is wound up. The cutting-off, in this case, is expediently carried out in such a manner that the two yarn ends are pressed together with one another which may take place, for example, by carrying out the cutting between a base, over which the double yarn is guided, and a blade that can be applied to it. It is also contemplated to reinforce, particularly in the area of its end 53, the double yarn used as the starter winding, so that it is ensured that the ends of the two yarn components are located at the same point. This may take place, for example, in that the end 53 of the starter winding 52 is sprayed with a hardening agent (hair spray) and is hardened. It is also contemplated to wind a wind-around yarn around the two double yarns and to fix them in this manner. In addition, it is contemplated to knot the two yarn components of the double yarn together in the area of their end. In addition, it is contemplated to fix and connect the yarns with one another by means of rubbing or swirling or the like, or by inserting an auxiliary yarn. All these measures have no influence on the double yarn that later forms the package because the end 53 of the starter winding 52, during the piecing operation (FIG. 3) which completes the exchange of yarn packages and spool cores, is cut off in the area of the splicing arrangement 72 and is removed as waste.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A process for automatically exchanging yarn packages and spool cores at a spinning unit of a machine having a plurality of spinning units which each contain devices for the spinning of two prestrengthened yarns and devices for winding these two yarns, as a double yarn, onto spool cores, to form yarn packages which serve as feeding packages for a subsequent twisting operation, said process comprising the sequential steps of:

interrupting the winding;

removing the full package taken out of the devices for the winding;

replacing the full package by a spool core having a starter winding with a starter yarn;

placing the double yarn coming from the devices for the spinning and the starter yarn in a splicing device and splicing them together with one another, and restarting the winding.

2. A process according to claim 1, wherein the spinning operation is automatically interrupted when a given degree of fullness of the yarn package is reached, and wherein the spinning operation is automatically restarted before the double yarn and the starter yarn are spliced together.

3. A process according to claim 1, wherein a movable servicing unit is selectively movable between respective spinning units, said servicing unit including means for removal of the full packages and replacement with the spool core having starter yarn.

4. A process according to claim 3, wherein said servicing unit also houses the splicing device, and means for placing the starter yarn and double yarn in the splicing device.

5. A process according to claim 4, wherein the spinning operation is automatically interrupted when a given degree of fullness of the yarn package is reached, and wherein the spinning operation is automatically restarted before the double yarn and the starter yarn are spliced together.

6. A spinning machine having a plurality of spinning units, each containing spinning means for the spinning of two prestrengthened yarns, yarn guide means for leading these prestrengthened yarns together to form a double yarn, and winding means for winding this double yarn onto a spool core, and automatic exchange apparatus for carrying out an automatic exchange of yarn packages and spool cores, said automatic exchange apparatus comprising:

separating means for separating a full package from the winding means, spool replacing means for replacing the full yarn package by a spool core having a starter yarn, yarn splicing means, yarn placement means for placing the starter yarn and the double yarn coming from the spinning means in the splicing means, rewinding means for rewinding the double yarn connected with the starter yarn and spool core transfer means for transferring the spool core to the winding means.

7. A spinning machine according to claim 6, wherein the spool replacing means and spool core transfer means are arranged in a servicing unit that can be moved along the spinning machine and can be selectively applied to the individual spinning units.

8. A spinning machine according to claim 6, wherein the splicing means, the yarn placement means, the rewinding means and the spool core transfer means are housed in a movable servicing unit.

9. A spinning machine according to claim 7, wherein the splicing means, the yarn placement means, the rewinding means and the spool core transfer means are housed in the movable servicing unit.

10. A spinning machine according to claim 6, wherein a single yarn is provided as the starter yarn, which has an increased strength and/or a coarser yarn size compared to the double yarn.

11. A spinning machine according to claim 6, wherein a double yarn is provided as the starter yarn, which corresponds to the double yarn produced by the spinning means with respect to the material and thickness.

12. A spinning machine according to claim 11, wherein the ends of the two yarns which form the double yarn serving as the starter yarn are connected with one another.

13. A spinning machine according to claim 10, wherein the end of the starter yarn is reinforced.

14. A spinning machine according to claim 6, wherein the end of the starter yarn is stiffened by means of a coating or impregnation.

15. A spinning machine according to claim 6, wherein the end of the starter yarn is reinforced by means of an auxiliary yarn.

16. A spinning machine according to claim 6, wherein means are provided for automatically restarting operation of the spinning means before splicing the double yarn and starter yarn together with the splicing means.

17. A spinning means according to claim 16, wherein means are provided for operating the rewinding means at a speed which moves the yarn faster than the spinning production speed, to thereby take-up the excess spun yarn accumulated in a storage device during the splicing operation.

* * * * *